US005351638A

United States Patent [19]

Helleberg

[11] Patent Number: 5,351,638

[45] Date of Patent: Oct. 4, 1994

[54] KEEL ASSEMBLY FOR A SAILBOAT

[75] Inventor: Niels C. Helleberg, Swampscott, Mass.

[73] Assignee: John G. Alden, Inc., Everett, Mass.

[21] Appl. No.: 180,027

[22] Filed: Jan. 11, 1994

[51] Int. Cl.[5] ..... B63H 25/00

[52] U.S. Cl. ..... 114/140

[58] Field of Search ..... 114/65 R, 127, 140, 114/141, 142, 143, 162, 343, 355

[56] References Cited

U.S. PATENT DOCUMENTS

| | | | |
|---|---|---|---|
| 2,119,881 | 6/1938 | Kline | 114/140 |
| 2,418,636 | 4/1947 | Harasty | 114/140 |
| 4,280,433 | 7/1981 | Haddock | 114/140 |
| 4,434,738 | 3/1984 | Barkemeyer | 114/162 |

*Primary Examiner*—Stephen P. Avila

*Attorney, Agent, or Firm*—Salter & Michaelson

[57] ABSTRACT

A keel assembly for a sailboat includes a base portion which is integrally formed with the underside of the hull of the sailboat, a keel portion which is adapted to be releasably received in assembled relation with the base portion, and a plurality of fastening element assemblies for securing the keel portion to the base portion. The fastening element assemblies include downwardly extending threaded rods which are permanently secured in sealed nonrotatable relation in the base portion. The threaded rods have flanges thereon which are received in nonrotatable relation in recesses in the underside of the base portion. The threaded rods are received and secured in downwardly extending fastening element passages in the keel portion which are accessible through transversely extending access passages in the keel portion.

10 Claims, 5 Drawing Sheets

KEEL ASSEMBLY FOR A SAILBOAT

BACKGROUND AND SUMMARY OF THE INVENTION

The instant invention relates to sailboats and more particularly to an improved keel assembly for fixed keel sailboat which enables the main components of the keel assembly to be readily removed for repair or replacement.

It is generally recognized that a keel or centerboard structure is an essential component of virtually any sailboat. It is further recognized that the performance characteristics of a sailboat can frequently be optimized by utilizing a fixed keel which is heavily weighted with a ballast material, such as lead. For this reason, most conventional sailboats over approximately 30 feet in length have included large permanently affixed keels which are made predominantly of lead.

The most common type of keel assembly utilized in the heretofore available sailboats of greater than approximately 30 feet in length comprises a molded keel element which is formed substantially entirely from solid lead and which includes a plurality of keel bolts which are permanently embedded in the lead structure thereof. A keel element of this type is normally permanently secured to the underside of a sailboat by passing the permanently embedded bolts in the keel element upwardly through holes in the underside of the boat hull and then securing the bolts in the interior of the hull. These bolts frequently thereafter become inaccessible from the interior of the hull as various structures, including flooring, bulkheads, etc. are assembled in the interior of the hull. Further, during the assembly of a keel element to a boat hull in this manner, a polymer marine sealant is normally applied between the keel element and the boat hull as well as around the keel bolts where they pass through the hull. As a result of this, and the inaccessibility of keel bolts in the interior of a hull it is often virtually impossible to remove a conventional permanently attached keel element from a boat hull either for the purpose of repairing damage to the keel element or the boat hull or for changing the configuration of the keel element. Specifically, it has been found that the sealants which have heretofore been utilized for securing the keel elements of most sailboats to the hulls thereof and the inaccessibility of keel bolts from the interior of most sailboats have made it virtually impossible to remove the keel elements of most sailboats without causing substantial damage to the respective hulls thereof. Further, this has remained the case despite the fact that it is generally recognized that in some situations it can be desirable to change the configuration of the keel element of a sailboat to adapt the boat for either shallow-water or deep-water sailing.

The instant invention provides an effective keel assembly which is adapted to permit the keel element of a sailboat to be readily and easily removed for repair or replacement. Specifically, the instant invention provides a keel assembly for a sailboat comprising a base portion and a keel portion, wherein the keel portion is attached to the base portion in a manner which permits the keel portion to be readily and easily disassembled from the base portion without causing damage to either the keel portion or the base portion. Still more specifically, the instant invention provides a keel assembly comprising a base portion which is integrally formed with the hull of a sailboat so that it extends downwardly a distance therefrom terminating in a first mating face, a plurality of elongated fasting elements which extend downwardly in sealed relation through fastening element holes in the base portion and outwardly through the first mating face and a keel portion comprising a second mating face which is received in mating engagement with the first mating face. The first mating face on the base portion preferably has a plurality of noncircular recesses formed therein, one of the recesses being formed around each of the fastening element holes in the base portion. The keel portion, which is preferably made from a weighted material, such as lead, has a plurality of tubular fastening elements passages formed therein which extend downwardly from the second mating face, and the fastening elements extend downwardly through the fastening element passages. The keel portion further includes a plurality of access passages which extend inwardly from one side of the keel portion and intersect the fastening element passages in the interior of the keel portion. Accordingly, the access passages enable the fastening elements to be manipulated while they are in the fastening element passages for securing the keel portion to or removing it from the base portion. The first and second mating faces on the base portion and the keel portion, respectively, are preferably received in mating engagement without sealants therebetween, and the fastening elements preferably pass downwardly in substantially unsealed relation through the fastening element passages in the keel portion. The fastening elements each comprise an elongated threaded shaft portion and a flange portion of noncircular configuration on the shaft portion, and they preferably also each comprise a nut portion which is received in threaded engagement with the shaft portion thereof in one of the access passage in the interior of the keel portion. The flange portions of the fastening elements are permanently and nonrotatably secured to the shaft portions thereof, and they are nonrotatably received in the recesses in the base portion. Further, the fastening elements preferably also include tubular sleeves which are welded to the shaft portions, and the flange portions are preferably welded to the tubular sleeves to permanently and nonrotatably secure them to the shaft portions. Specifically, the tubular sleeves preferably include side apertures therein, and the sleeves are preferably welded to the respective shaft portions thereof in the apertures to avoid weakening the shaft portions as the sleeves are welded thereto. The first and second mating faces preferably each include a substantially horizontal, forward, upper portion, a substantially horizontal, rearward, lower portion and an angular shoulder portion which extends downwardly from the respective forward, upper portion thereof to the respective rearward, lower portion thereof. The keel assembly preferably further includes means comprising a removable plastic filler material for removably closing the access passages. Accordingly, when it becomes necessary to remove the keel portion from the base portion, the plastic filler material in the access passages, which may be covered with an anti-fouling paint, can be easily located by tapping lightly on the sides of the keel portion to locate the access passages.

Accordingly, it is seen that the instant invention provides an effective keel assembly for a sailboat. The keel portion is adapted to be secured to the base portion without the use of sealants. In this regard, the fastening elements are permanently sealed in the base portion rather than being embedded in the keel portion. Hence, it is not necessary to utilize additional sealants between the base portion and the keel portion which would prevent easy removal of the keel portion. However, because the fastening elements are accessible through the access passages in the keel portion, the fastening elements can be readily and easily manipulated to loosen and remove the keel portion from the base portion. Further, the flange portions prevent the fastening elements from rotating in the base portion so that it is not necessary to gain access to the fastening elements in the interior of the hull when securing the keel portion to the base portion or when removing the keel portion therefrom. Even still further, because the access passages are normally covered by a low density plastic material, the substantial difference between the density of the plastic material and the density of lead in the keel portion makes it easy to locate the access passages for removing the keel portion even though the plastic material may be faired in and covered with an anti-fouling paint.

Accordingly, it is an object of the instant invention to provide a keel assembly for a sailboat comprising a base portion which is integrally formed with the hull of the sailboat and a keel portion which is releasably securable to the base portion.

Another object is to provide a keel assembly for a sailboat comprising a base portion and a keel portion which is attached to the base portion in a manner which enables the keel portion to withstand minor impacts without causing significant damage to the base portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
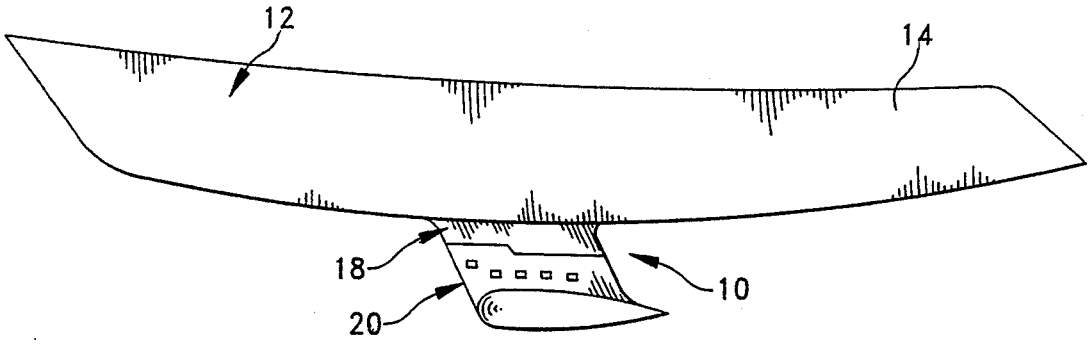
FIG. 1 is a side elevational view of a sailboat which comprises the keel assembly of the instant invention.
Figure 2:
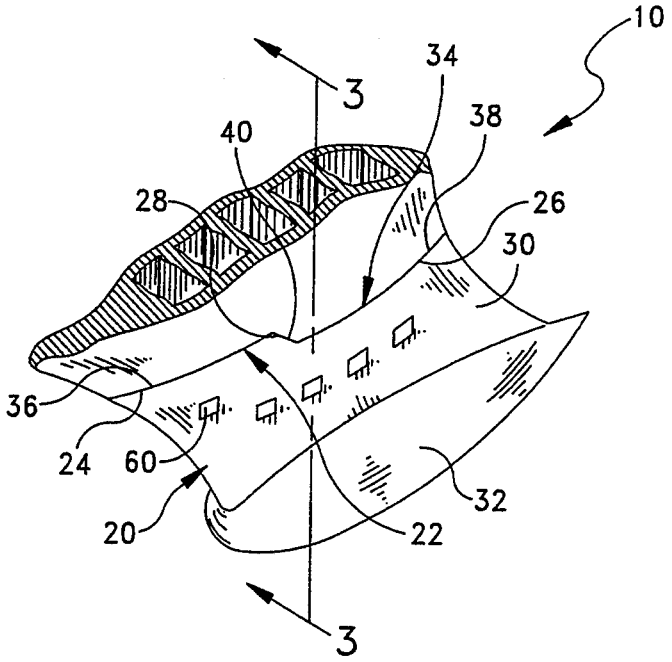
FIG. 2 is a fragmentary perspective view thereof illustrating the keel assembly of the instant invention.
Figure 3:
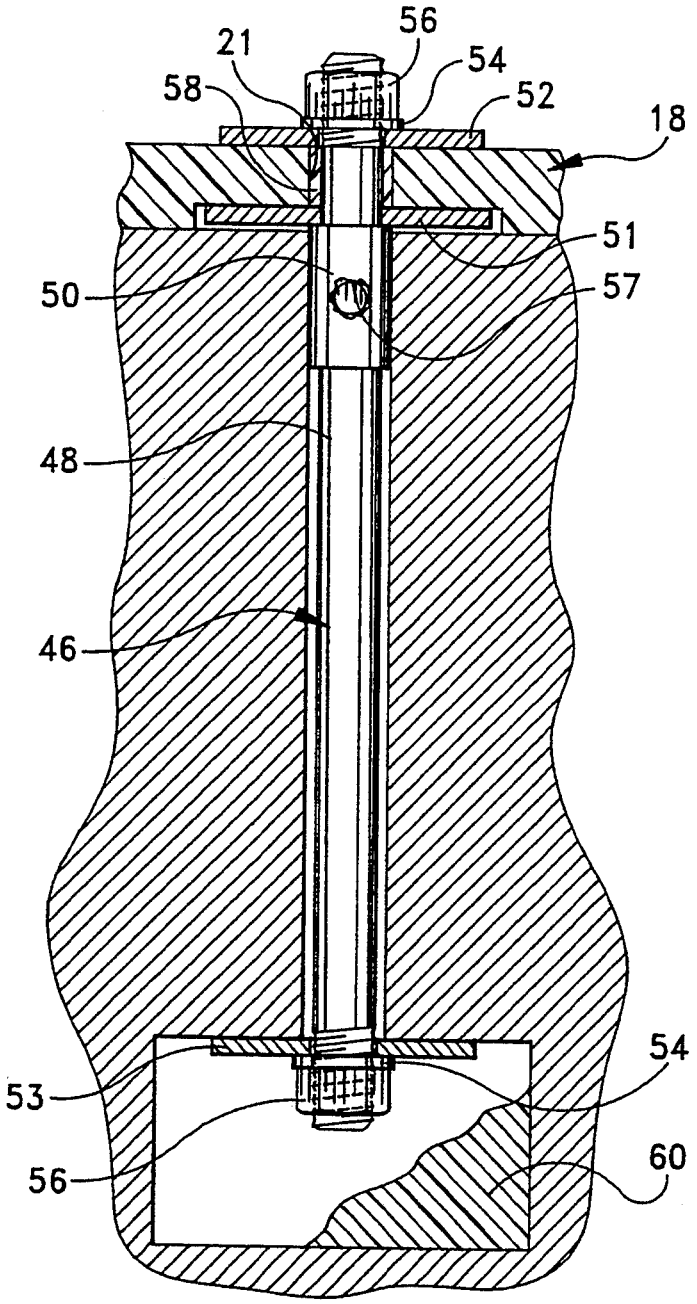
FIG. 3 is a sectional view taken along line 3—3 in FIG. 2.
Figure 4:
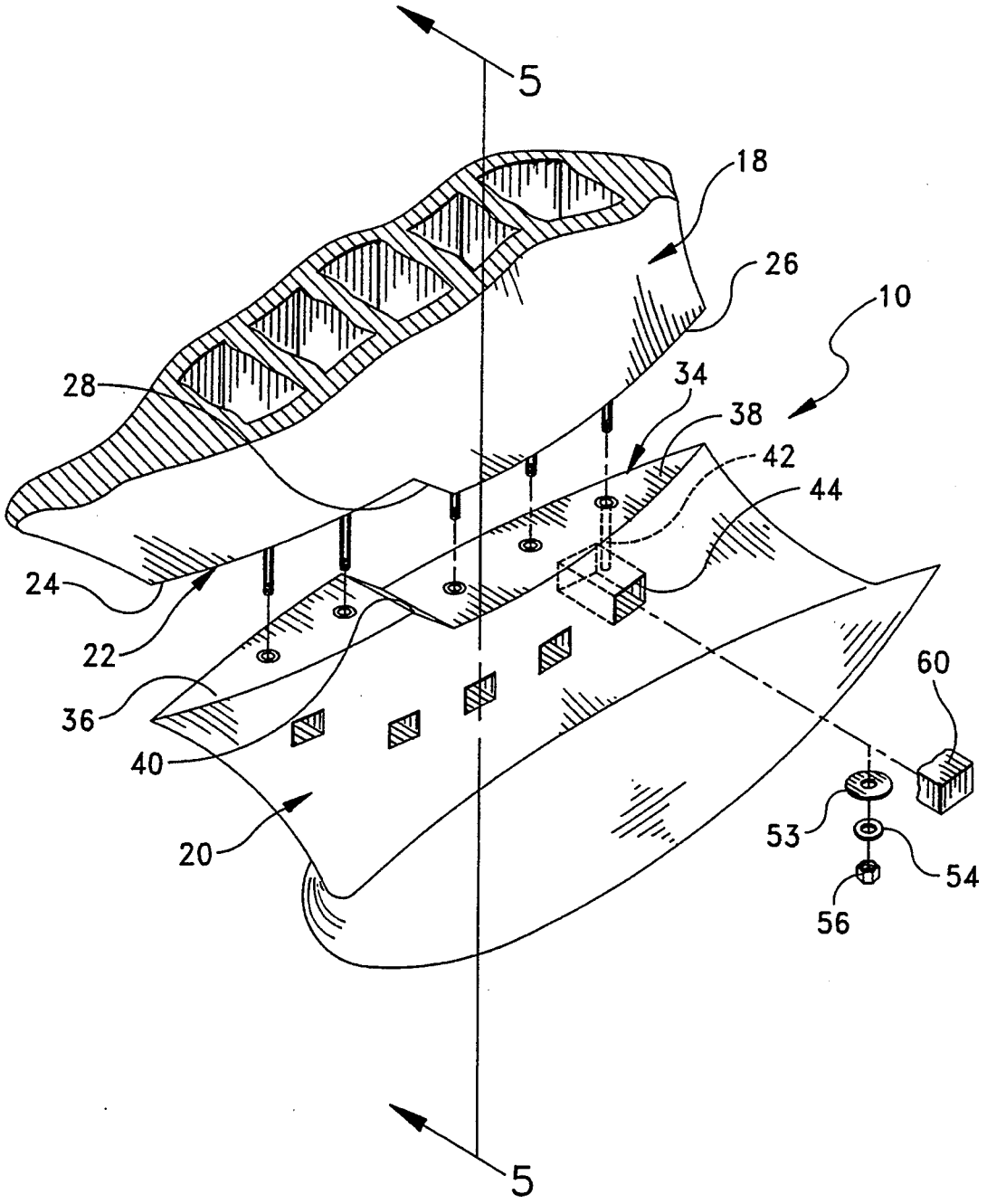
FIG. 4 is an exploded perspective view of the assembly illustrated in FIG. 2.

Referring now to the drawings, a first embodiment of the keel assembly of the instant invention is illustrated in FIGS. 1 through 5 and generally indicated at 10 in FIGS. 1, 2, and 4. The keel assembly 10 is formed as part of a sailboat generally indicated at 12 in FIG. 1, which includes a hull 14, and it comprises a base portion generally indicated at 18, which is integrally formed on the underside of the hull 14, and a keel portion generally indicated at 20, which is removably assembled with the base portion 18 in a manner which will hereinafter be more fully set forth.

Figure 5:
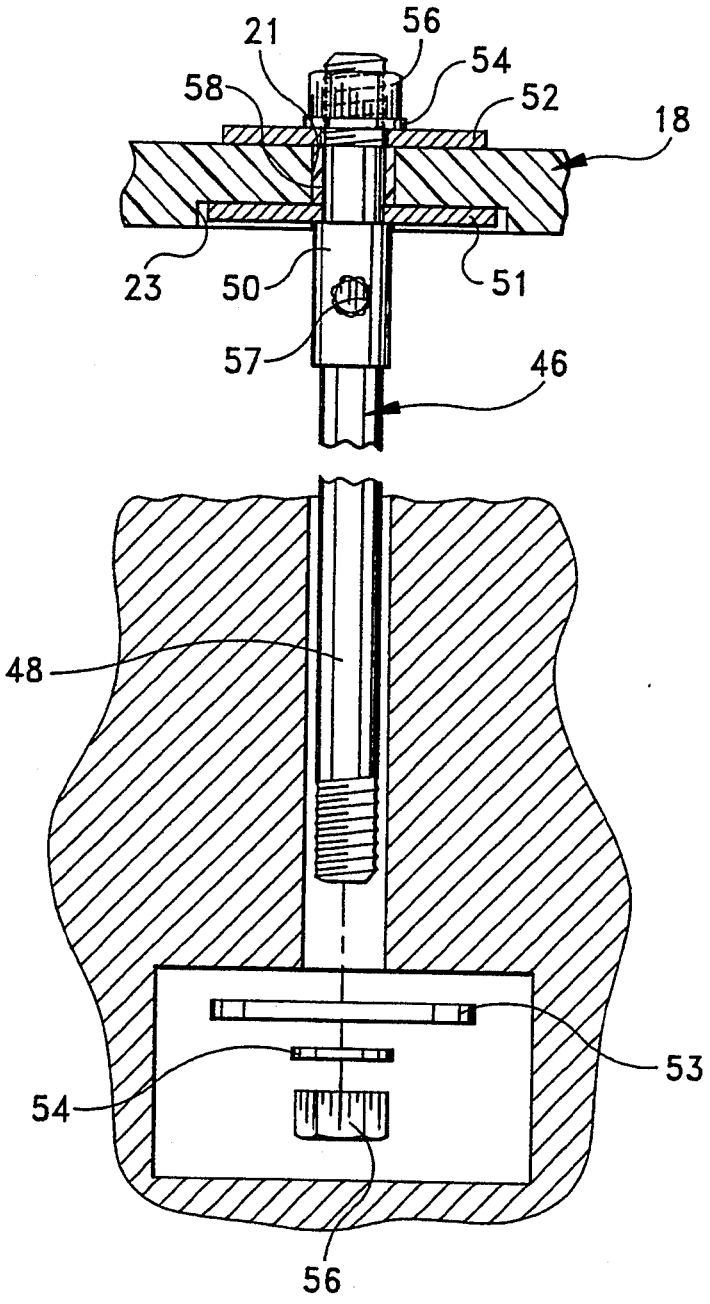
FIG. 5 is a sectional view taken along line 5—5 in FIG. 4.
Figure 7:
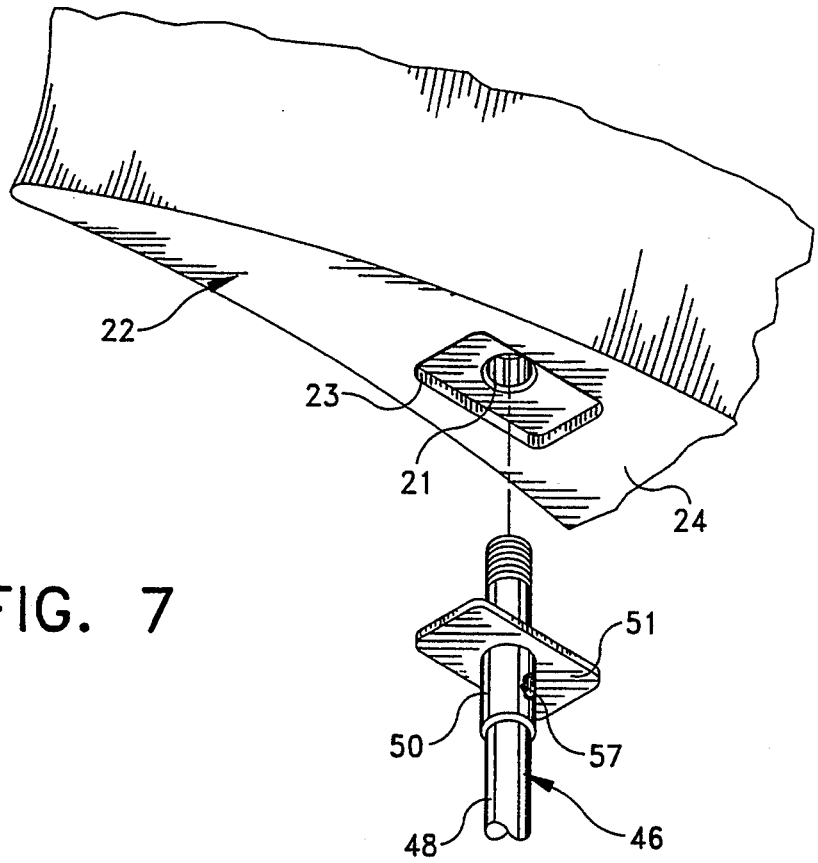
FIG. 7 is a bottom fragmentary perspective view of the base portion of the keel assembly and one of the keel bolts.

The base portion 18 is preferably integrally formed with the hull 14 from a suitable material, such as fiberglass, and, as illustrated most clearly in FIG. 1, it extends integrally downwardly from the underside of the hull 14. The base portion 18 has a plurality of downwardly extending fastening element holes 21 therethrough, and it terminates in a downwardly facing first mating surface generally indicated at 22 which is adapted to be received in face-to-face mating engagement with a corresponding surface on the keel portion 20, as will hereinafter be more fully set forth. The first mating surface 22 has a plurality of noncircular (preferably rectangular) recesses 23 formed therein, one of the recesses being formed around each of the fastening element holes 21 as illustrated in FIGS. 5 and 7. The first mating surface 22 includes a substantially horizontal, forward upper portion 24, a substantially horizontal, rearward, lower portion 26 and an angular, shoulder portion 28 which extends angularly downwardly and rearwardly from the forward upper portion 24 to the rearward, lower portion 26. Accordingly, the shoulder portion 28 forms an angularly disposed shoulder which is operative for transmitting shocks delivered to the front of the keel portion 20 directly to the base portion 18 and the hull 14 rather than transmitting such shocks to the base portion 18 through the fastening means utilized for securing the keel portion to the base portion 18.

The keel portion 20 is preferably integrally molded or cast from a suitable weighted material, such as lead or a lead alloy, to provide a desired amount of ballast for the sailboat 12. In this regard, as herein embodied the keel portion 20 is formed as a shallow draft reef keel comprising an upper or main portion 30, and a lower or wing portion 32, although it will be understood that the keel portion 20 can alternatively be formed in a variety of other conventional configurations, such as the one illustrated in FIG. 6. In any event, the keel portion 20 includes an upper or second mating face generally indicated at 34 which is adapted to be received in mating face-to-face engagement with the first mating face 22. Accordingly, the second mating face 34 includes an upper, forward portion 36, a rearward, lower portion 38 and a shoulder portion 40 which extends angularly downwardly from the forward upper portion 36 to the rearward lower portion 38. As illustrated most clearly in FIG. 4, the keel portion 20 also has a plurality of downwardly extending tubular fastening element passages 42 therein as well as a plurality of access passages 44 which extend transversely through the keel portion 20 and intersect the tubular fastening element passages 42.

Also included in the keel assembly 20 is a plurality of fastening element assemblies generally indicated at 46. Each of the fastening element assemblies 46 comprises an elongated rod 48 which is threaded at opposite ends thereof, a compression sleeve 50 having a flange 51 thereon, a pair of upper and lower reinforcing plates 52 and 53, respectively, a pair of washers 54 and a pair of threaded nuts 56. Each of the flanges 51 is welded to the respective compression sleeve 50 thereof, and each of the compression sleeves 50 has an aperture 57 therein where each compression sleeve 50 is welded to the respective rod 48 thereof. In this regard, it has been found that by welding the compression sleeves 50 to the rods 48 in the apertures 57 weakening of the rods 48 during the welding operation is minimized. Each of the rods 48 is assembled in the base portion 18 so that each rod 48 passes downwardly in permanently sealed relation through one of the holes 21 in the base portion 18. A reinforcing plate 52, a washer 54 and a nut 56 are assembled on each rod 48 in the interior of the base portion 18, and because the flanges 51 are nonrotatably received in the recesses, the nuts 56 can more easily tightened in the interior of the base portion 18. A sealant 58 is applied around each of the rods 48 in the areas of engagement thereof with the base portion 18 to permanently secure and seal the fastening element assemblies 46 to the base portion 18 and to permanently seal around the rods 48 where they pass through the base portion 18. In this regard, the sealant 58 preferably comprises a permanent sealant, such as conventional marine polymer sealant, and it is applied to the rods 48 in the areas where the rods 48 pass through the base portion 18. Further since the flanges 51 are received in nonrotatable relation in the recesses it is possible to permanently assemble various items, such as pumps, generators, flooring etc. in the interior of the base portion 18 which might limit access to the upper nuts 56.

Each of the threaded rods 48 is assembled in the keel portion 20 so that each rod 48 passes downwardly through one of the fastening element passages 42, and a reinforcing plate 53, a washer 54 and a nut 56 are assembled on each rod 48 in the access passage 44 thereof. The threaded rods 48 preferably pass downwardly through the fastening element passages 42 in unsealed relation, i.e. sealants are not normally applied between the fastening element assemblies 46 and the keel portion 20, so that the keel portion 20 can be removed from the base portion 18 by simply removing the lower nuts 56 and the corresponding washers 54 and reinforcing plates 53 thereon in the access passages 44. In this regard, because the flanges 51 are nonrotatably received in the recesses 23, it is possible to remove or tighten the lower nuts 56 without holding the upper nuts 56 or the rods 48 so that the lower nuts 56 can be removed without gaining access to the nuts 56 in the interior of the base portion 18. It is further important to note that sealants are not normally applied between the base portion 18 and the keel portion 20. Consequently, the keel portion 20 can be readily removed from the base portion 18 for repair or replacement. In any event, the fastening element assemblies 46 are operative for firmly and positively securing the keel portion 20 to the base portion 18 so that the mating faces 22 and 34 are received in snug, mating engagement. The keel portion 20 preferably further includes filler elements 60 comprising a suitable hardening polymer filler material such as a synthetic foam and/or a body-putty type compound. Accordingly, the filler elements 60, which are normally faired in with the keel portion 20, fill the access passages 44 to provide a smooth outer configuration for the keel portion 20. However, because the filler elements 60 are normally made from a material, such as a synthetic foam and/or a body-putty type compound, which is substantially less dense than the lead material from which remainder of the keel portion 20 is constructed, it is possible to easily determine the locations of the filler elements 60 even after the keel assembly 10 has been painted with an anti-fouling paint. Accordingly, it is normally possible to readily remove the filler elements 60 to provide access to the fastening element assemblies 46 in the access passages 44 when necessary.

Figure 6:
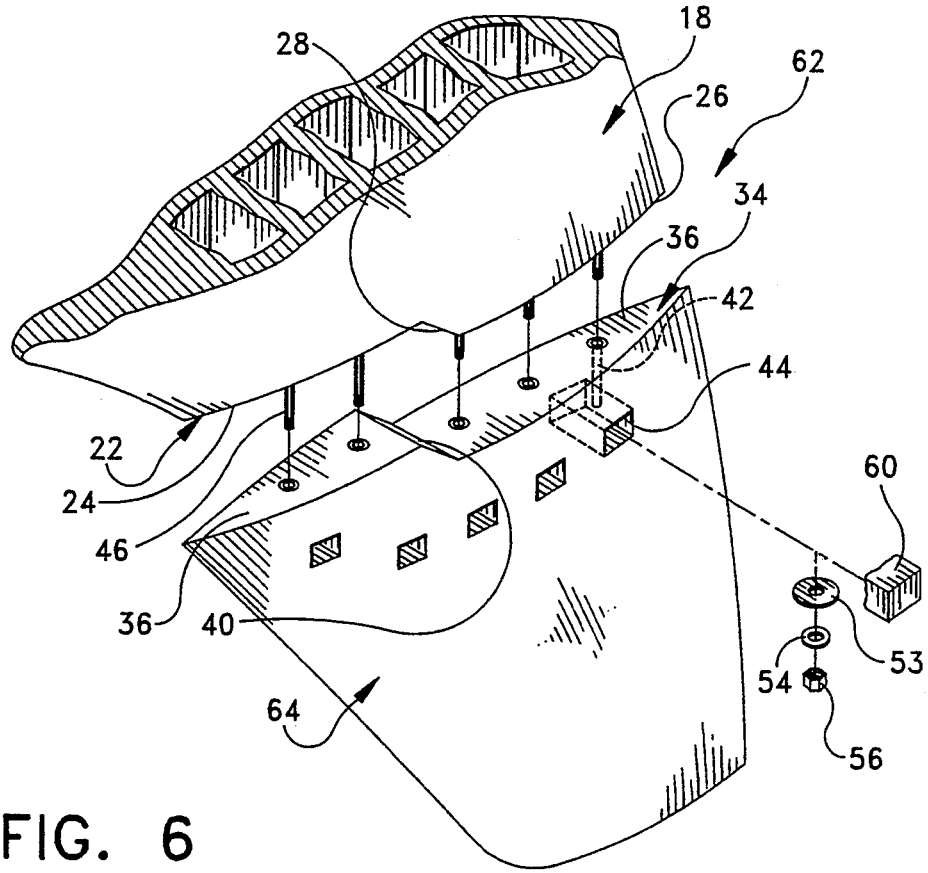
FIG. 6 is an exploded perspective view of the base portion of the keel assembly with a keel portion of a different configuration.

Referring now to FIG. 6, a second embodiment of the keel assembly of the instant invention is illustrated and generally indicated at 62. The keel assembly 62 is identical to the keel assembly 10 with the exception that it includes a keel portion 61 which is formed as a deep water keel rather than as a shoal or shallow water keel. However, the keel portion 64 is nevertheless adapted to be secured to the base portion 18 utilizing fastening element assemblies 46 which are permanently secured in the base portion 18 and which are adapted to be received in unsealed relation in the fastening element passages 42 in the keel portion 64. The keel portion 64 further includes a plurality of access passages 44 and a plurality of filler elements 60. The keel portion 64 is normally secured to the base portion 18 without the use of sealants between the mating faces 22 and 34 thereof. Further, the flanges 51, which are welded to the compression sleeves 50 thereof, are nonrotatably received in the respective recesses 23 thereof to prevent the rods 48 from rotating as the lower nuts 56 are loosened or tightened. Hence, the keel assembly 62 is also adapted to permit the keel portion 64 to be easily removed from the base portion 18 for repair or replacement.

It is seen therefore that the instant invention provides an effective keel assembly for a sailboat. The keel assemblies 10 and 62 are adapted to permit the keel portions 20 and 64 thereof, respectively, to be readily removed from the base portions 18 thereof. In this regard, the fastening element assemblies 46 are permanently sealed and secured in nonrotatable relation in the base portions 18. However, they are not normally sealed to the keel portions 20 or 64, and the keel portions 20 and 64 are not normally sealed to the respective base portions 18 thereof. Further, the mating faces 22 and 34 of the keel assemblies 10 and 62 include the shoulder portions 28 and 40 to enable the keel assemblies 10 and 62 to more effectively withstand shocks caused by collisions with submerged objects during forward movement. Hence, it is seen that the keel assembly of the instant invention represents a significant advancement in the art relating to sailboat construction which has substantially commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. In a keel assembly for a sailboat hull comprising a base portion which is integrally formed with said hull so that said base portion extends downwardly therefrom terminating in a first mating face, said base portion having a plurality of downwardly extending fastening elements holes therethrough, a plurality of elongated fastening elements extending downwardly in sealed relation through said fastening element holes in said base portion and outwardly through said first mating face, and a keel portion having opposite first and second side faces and including a second mating face which is received in mating engagement in a predetermined assembled position with said first mating face, said keel portion further including a plurality of fastening element passages extending downwardly therein from said second mating face, said fastening elements extending downwardly through said fastening element passages and securing said keel portion to said base portion, said keel portion further including a plurality of access passages extending transversely inwardly from said first side face thereof toward said second side face thereof and intersecting said fastening element passages, said fastening elements being manipulatable through said access passages to effect the assembly of said keel portion with or without the removal thereof from said base portion, the improvement comprising said base portion having a recess formed in said first mating face around each of said fastening element holes, said fastening elements each comprising a shaft portion extending downwardly through said base portion and through said keel portion to one of said access passages, and a permanently attached flange portion on the shaft portion thereof between said base portion and said keel portion, each of said flange portions being nonrotatably received in one of said recesses.

2. In the keel assembly of claim 1, said recesses being of noncircular configuration, said flange portions being of noncircular configuration and being dimensioned and configured to be nonrotatably received in said recesses.

3. In the keel assembly of claim 1, said recesses being of rectangular configuration, said flange portions being of complimentary rectangular configuration to said recesses.

4. In the keel assembly of claim 1, said fastening elements each further comprising a tubular compression sleeve permanently secured to the shaft portion thereof, each of said flange portions being permanently secured to the sleeve thereof to secure each said flange portion to the shaft portion thereof.

5. In the keel assembly of claim 4, each of said sleeves having a side aperture therein and being welded to the shaft portion thereof in the respective side aperture thereof.

6. In the keel assembly of claim 5, each of said flange portions being welded to the respective compression sleeve thereof.

7. In the keel assembly of claim 1, each of said fastening elements including an upper threaded portion, and a threaded nut received on the upper threaded portion thereof.

8. In the keel assembly of claim 1, said fastening elements being permanently sealed in said base portion.

9. In the keel assembly of claim 8, said first and second mating faces each including a substantially horizontal forward upper portion, a substantially horizontal rearward lower portion and a shoulder portion extending downwardly from the forward upper portion thereof to the rearward lower portion thereof, the forward upper portion, the shoulder portion and the rearward lower portion of said first mating face being received in mating engagement with the forward upper portion, the shoulder portion and the rearward lower portion, respectively, of said second mating face.

10. In the keel assembly of claim 9, said shoulder portions of said first and second mating faces extending angularly, downwardly and rearwardly from the respective forward upper portions thereof to the respective rearward, lower portions thereof.

* * * * *